United States Patent [19]

Bode et al.

[11] Patent Number: 4,698,902

[45] Date of Patent: Oct. 13, 1987

[54] METHOD OF MAKING COMMUTATOR RINGS

[75] Inventors: Werner Bode, Hildesheim; Peter Franz, Diekholzen; Reiner Hausdorf, Hildesheim; Günter Schulze, Klein Elbe, all of Fed. Rep. of Germany

[73] Assignee: Robert Bosch GmbH, Stuttgart, Fed. Rep. of Germany

[21] Appl. No.: 554,199

[22] Filed: Nov. 22, 1983

[30] Foreign Application Priority Data

Nov. 23, 1982 [DE] Fed. Rep. of Germany ..... 3243191

[51] Int. Cl.[4] ..... H01R 43/06

[52] U.S. Cl. ..... 29/597; 72/370

[58] Field of Search ..... 29/597; 72/354, 370; 310/236

[56] References Cited

U.S. PATENT DOCUMENTS

| | | | |
|---|---|---|---|
| 1,378,442 | 5/1921 | Chalfant | 72/370 |
| 2,367,783 | 1/1945 | Kerwin et al. | 72/370 X |
| 3,468,020 | 9/1969 | Carlson et al. | 29/597 |
| 3,566,651 | 3/1971 | Tlaker | 72/370 X |
| 3,568,303 | 3/1971 | Ito et al. | 72/370 X |
| 4,216,575 | 8/1980 | Carnavos et al. | 72/370 X |

FOREIGN PATENT DOCUMENTS

| | | | |
|---|---|---|---|
| 36444 | 9/1981 | European Pat. Off. | 29/597 |
| 181441 | 10/1983 | Japan | 72/370 |
| 651882 | 3/1979 | U.S.S.R. | 72/354 |
| 682306 | 8/1979 | U.S.S.R. | 72/354 |

*Primary Examiner*—Howard N. Goldberg
*Assistant Examiner*—Joseph M. Gorski
*Attorney, Agent, or Firm*—Frishauf, Holtz, Goodman & Woodward

[57] ABSTRACT

A method of making a commutator ring (2) for a commutator, which is provided with a plurality of commutator segments (7) with connection lugs (10) and anchoring means (44) and which is cold-formed by reduction and gauging in a single manufacturing step of a forming apparatus from a blank (1) with preformed segmental grooves (6) and a flange (4) which can subsequently be made into connection lugs. The forming apparatus is provided with a single or multi-stage, single or multi-part die. The blank is pressed against the die by radially disposed slides (39, 59) of the apparatus which are adjacent each commutator segment (7) and connection lug (10). Finally, during retraction of the die from the blank, the anchoring means (44) are formed on the commutator segments by a gauging apparatus being drawn through the tubular blank to "mushroom" inner teeth of the blank and shape them to form dovetail shaped anchors in a commutator hub sleeve. The die serves as an ejector for the finished commutator ring during its return movement to its initial position. After assembly to the commutator hub sleeve, the remaining connecting elements (8, 11) which held the commutator segments and connection lugs in closed, ring shape are removed or severed.

14 Claims, 11 Drawing Figures

METHOD OF MAKING COMMUTATOR RINGS

Cross reference to related applications, assigned to the assignee of the present application, the disclosures of which are hereby incorporated by references: U.S. Ser. 552,984, filed Nov. 17, 1983, new U.S. Pat. No. 4611,391 FRANZ et al "COMMUTATOR RING MANUFACTURING METHOD, AND APPARATUS"; U.S. Ser. No. 552,977 filed Nov. 17, 1983 now abandoned, BODE et al "METHOD OF MAKING A COMMUTATOR RING HAVING SEGMENTS".

The present invention relates to a method of manufacturing commutator rings, and more particularly to the manufacture of a commutator ring with a circumferential flange and multiple inwardly projecting ribs from a blank metal ring by cold-extrusion.

BACKGROUND

It is known to press a commutator ring provided with intersegmental grooves into a hollow cone and thereby reduce its size. This can cause the cross pieces in the longitudinal grooves between the individual commutator segments in the hollow core's inner wall to crumple outward so that they protrude on the rolling surface of the commutator segments. The crosspieces are removed from the segments in a later manufacturing step. Anchoring means are formed on the inner sides of the commutator segments and project radially into the segmental grooves. This known method has the disadvantage that the commutator ring is formed by axial movement of parts of the apparatus. Cold-forming using this process results in segments in the region of the ends which have a smaller cross section than those in the middle of the commutator ring. In the region of the ends of the commutator ring, there is less material on the inner side of the commutator segments for formation of anchoring means. The commutator segments can therefore not be securely fastened into the insulating hub, so that in fast-running electrical machines the commutator segments are pulled by centrifugal force out of their anchorage in the insulating hub.

THE INVENTION

It is an object to apply forming forces to a pre-formed commutator ring and flange simultaneously along the entire length thereof as well as on the flange to form commutator segment anchoring ridges, for example in form of a dovetail, simultaneously with shaping and sizing the commutator ring.

Briefly, the blank is placed in a die of a forming apparatus. The outer diameter of the blank is reduced by reduction elements in the apparatus acting radially on the individual segments and on the flange portions which will, later on, form attachment lugs. Radial compression can be obtained, for example, by including in the die wedge-shaped slide elements which, upon vertical movement of a die element, engage a slanting surface to transfer the vertical movement into a radial inward movement. The commutator segments themselves are anchored to a hub section by forming, together with the hub section, a reentrant projection-and-recess engagement, for example in the form of a dovetail joint. The blanks, as received in the forming apparatus, and when being subjected to the method, have internally projecting ribs or ridges. By drawing a die element, for example in the shape of a ball or ball portion, or with a rounded outer circumference through the tubular blank, the inwardly projecting ribs or teeth are deformed at the ends thereof to assume the aforementioned dovetail shape. The commutator ring, thus being accurately sized, and internally deformed to provide anchoring projections for later use, is then ejected by opening of the forming apparatus, for example by a punch element within the forming apparatus.

The method permits reduction of the commutator ring, in outer size, with relatively modest forming forces. The extent of reduction depends on the difference between initial and final diameter of the commutator ring. A power stroke having one or more stroke stages may be used.

The method of the present invention has the advantage that it can be carried out quickly, and only little time is required from insertion of the blank through ejection of the finished commutator ring, the stroke movements of the die being carried out rapidly. The sizing of the blank is accomplished accurately by reducing the flange and segment portions by the application of the radial force. Application by slides, associated with each commutator segment and converting axial movement to radially inwardly directed movement is particularly suitable. The forming apparatus has an upper and a lower portion, separated for reception of the blank and upon ejection. The slides can be formed on either the upper or lower portion, thus providing substantial freedom of design to the apparatus supplier. The inside of the commutator ring is formed by a multi-part die element. Using a multi-stage powers stroke permits conjoint operation during the movement of the upper and lower die. One of the dies, at the termination of the process, then also can act as an ejector to eject the finished commutator ring from the apparatus, after opening of the upper and lower parts thereof.

DRAWINGS

FIGS. 2 through 6 are primarily longitudinal cross sections;

DETAILED DESCRIPTION

Figure 1:
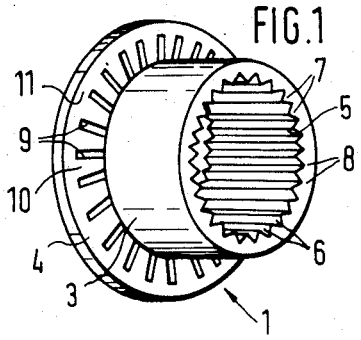
FIG. 1 is a perspective view of a blank for a commutator ring.
Figure 7:
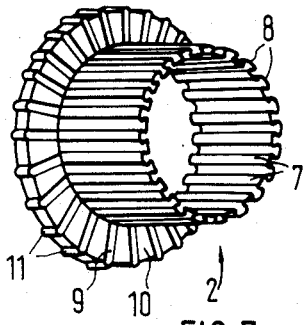
FIG. 7 is a perspective view of the blank at the end of the power stroke.

A blank 1 for a commutator ring 2 of a commutator is made from a material adapted for commutators, for example copper. Blank 1 has the form of a tube at one end of whose shaft or hub portion 3 a flange 4 is formed. The inner wall 5 of the shaft 3 is provided with segmental grooves 6 disposed at equal intervals from each other and running parallel to the longitudinal axis of the tube. The grooves 6 separate the commutator segments except for cross pieces 8 around the outer jacket of the tube. The segmental grooves 6 extend into the flange 4 as slits 9. Slits 9 divide the flange into the connection lugs 10 associated with the individual commutator segments 7. The connection lugs 10 are connected by cross pieces 11 along the outer rim of the flange 4. The blank 1 may typically be formed by extrusion. It has a greater diameter than the commutator ring 2 and is provided with segmental grooves 6 and slits 9 serving as lug dividers, of greater width than those of the finished commutator ring 2. The tools for making the segmental grooves 6 and the slits 9 of the blank 1 have a longer service life when the dimensions employed are greater. This is particularly important in mass production.

In cold-forming the blank 1 into the commutator ring 2, the shaft 3 and the flange 4 of the blank 1 are reduced in diameter. The reduction is achieved, in accordance with the method of the invention, by placing the blank 1 on a die which has teeth which match with the segmental grooves 6. Slides acting radially on each of the commutator segments 7 and connection lugs 10 press the commutator segments 7 further between the teeth of the die. This bows outward the cross pieces 8 and 11 and the segmental grooves 6 are narrowed to the desired scale of the commutator ring 2. The reduction occurs in one or more stages of a power stroke with a corresponding single or multi-part die. The final formation of the dovetail-shaped anchoring means on the inner sides of the commutator segments 7 is achieved by an extrusion device as a continuation of the power stroke or during retraction of the die out of the blank 1. In any case, the die is used for ejection of the commutator ring 2.

The cold-forming of the blank 1 into the commutator ring by reduction is accomplished in a single working step of a multi-part forming apparatus.

A first embodiment of the forming apparatus is depicted in FIGS. 2 through 6. The forming apparatus has (FIG. 2) a lower support plate 12, in which is disposed a receptacle 13 for locking pins 14. The locking pins 14 are disposed at equal angular intervals from each other, which correspond to the angular intervals between the slits 9 in the flange 4 of the blank 1. On the lower support plate 12 rests a bell-shaped punch plate 15 in which is disposed a hollow die 16. The die 16 projects out of the punch plate 15 with an end formed as a flange 17. The free face 18 of the flange 17 represents the receptacle for the workpiece and forms the receiving surface for the blank 1. The punch plate 15 has on its upper side a frusto-conical coaxial recess 19 with an outwardly inclined wall 20.

Into the lower support plate 12, the receptacle 13 and the die 16, 17, a lower punch 21 is introduced in a longitudinally movable but non-rotatable manner. On the outer face of the lower punch 21, a lower die 22 of a multi-part die for processing of the blank 1 is fastened. The outer surface of the lower die 22 is provided with teeth disposed at equal angular intervals from each other. The teeth align in the axial direction with the locking pins 14 for the slits 9 which form the lug grooves. The cross section of the teeth 23 has the form of the segmental grooves 6 of the blank 1 at the end of the first stage of the power stroke of the forming process.

In an upper support plate 24, a slide receptacle 25 is movably disposed. The slide receptacle 25 is provided on its face 26 adjacent the punch plate 25 with radially running slits 27, which open into a central bore 28 of the slide receptacle 25. The slits 27 are again arranged at equal angular intervals to each other and align with the interstices between the locking pins 14 and the lower half of the apparatus. In each slit 27, a slide 29 is movably disposed. The outer end of each slide 29 is formed as a widened bearing surface 30 for a spring arrangement 31. The spring arrangement 31 is supported at its other end against the slide receptacle 25. The outer face 32 of the slide 29 is inclined at the same angle as the wall 20 of the recess 19 of the punch plate 15. The form of the inner face 33 of the slide 29 corresponds to the outer surface of the commutator segments 7 between the cross pieces 8 which connect them. On the inner rim, the inner face 33 of the slide 29 is provided with a chamfer 34. The outer rim of the inner face 33 is provided with a recess 35 which corresponds to the flange 4 of the blank 1. The slits 27 of the slide receptacle 25 are covered by an annular plate 36 which is screwed onto the face 26 of the slide receptacle 25.

In the central bore 28 of the slide receptacle 25, an upper punch 37 is introduced in a longitudinally movable but non-rotatable manner. On the face 38 of the upper punch 37, an upper die 39 of the multi-part die is fastened. The upper die 39 is provided with teeth 40 in the same manner as the lower die 22. The form of the teeth 40 corresponds to the form of the segmental grooves at the end of the power-stroke (see also FIG. 8).

A gauging apparatus is fastened on the face 41 of the upper die 39 adjacent the lower die 22. It consists of a gauging ring 42, which is screwed onto the upper die 39. The gauging ring 42 has an outer diameter which is greater than that of the diameter of the base of the teeth of the upper die 39.

OPERATION

Figure 2:
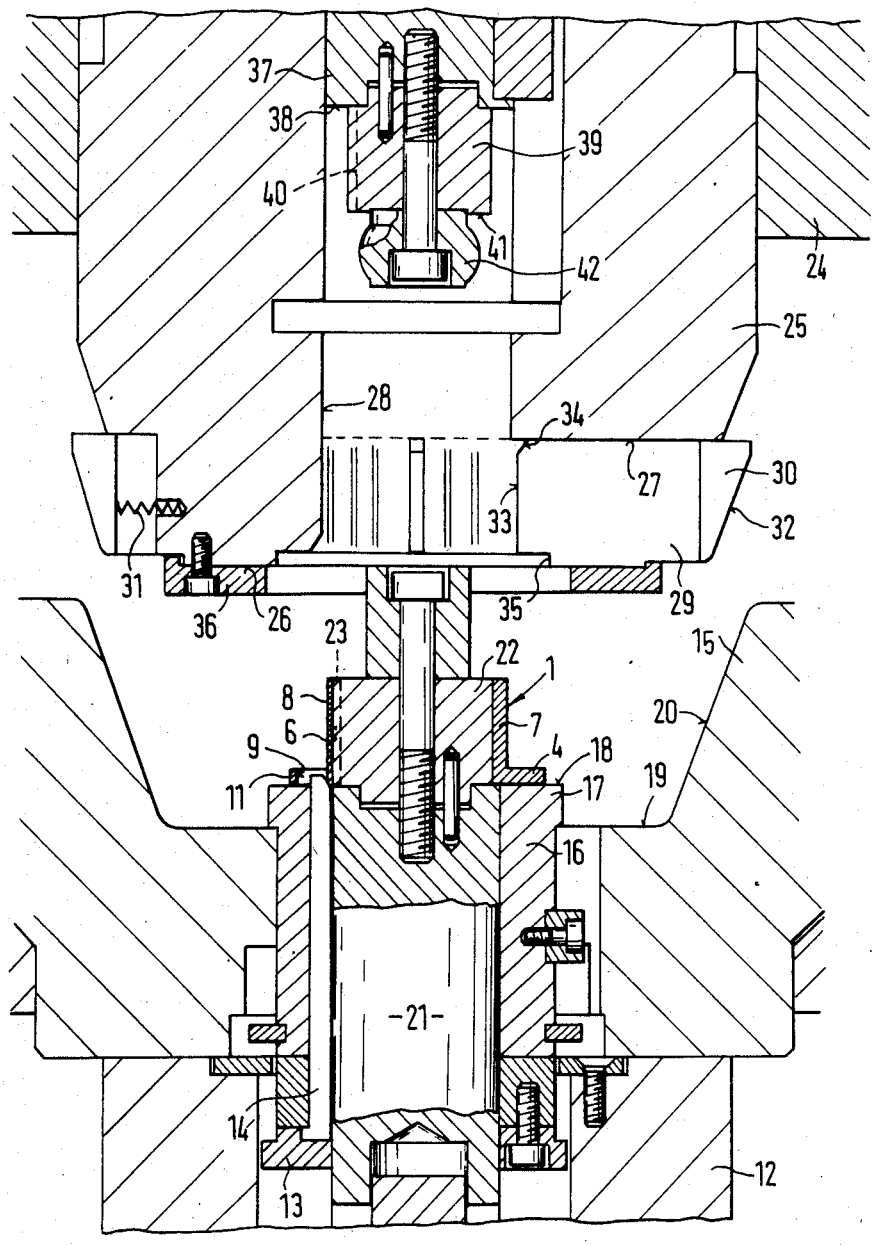
FIG. 2 shows a first embodiment of a forming apparatus with multi-part dies, in the initial position with an inserted blank.

For forming into the commutator ring 2, the blank 1 is placed on the lower die 22 of the forming device which is in its initial position (FIG. 2). The flange 4 rests on the face 18 of the hollow die 16 which surrounds the lower punch. The locking pins 14 which extend through the die 16 lock into the slits 9 in the flange 4 of the blank 1. The upper punch 37, along with the upper punch 39 and the gauging ring 42 in the central bore 28 of the slide receptacle 25, is pulled back out of the area of the slides 29. The slides 29 are held pressed in their outermost position out of the central bore 28 by the spring arrangement 31.

Figure 3:
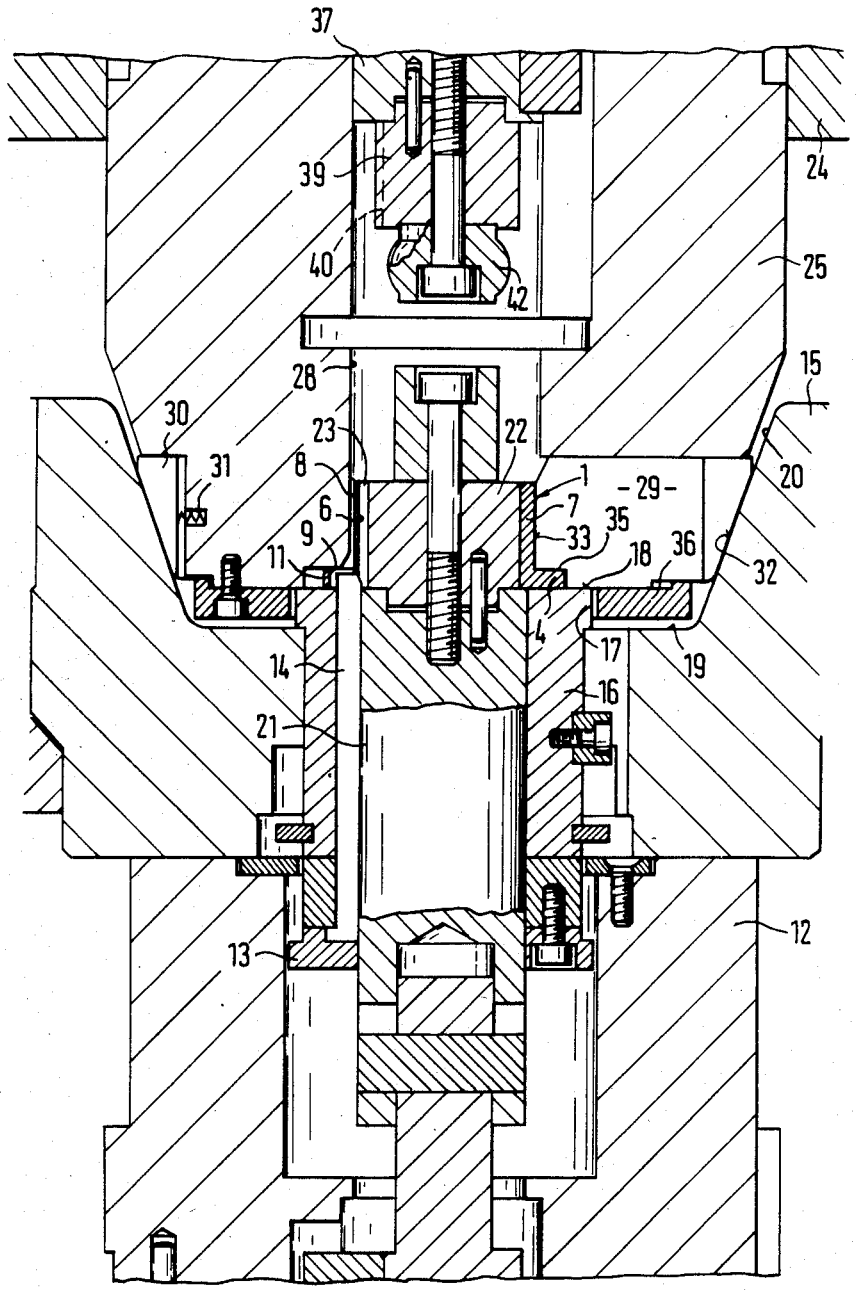
FIG. 3 shows the apparatus at the end of the first stage.

After the insertion of the blank 1, the slide receptacle 25 is moved toward the recess 19 of the punch plate 15 (FIG. 3). Thus the inclined faces 32 of the slides 29 slip against the inclined wall 20 of the recess 19 of the punch plate 15. The longitudinal movement of the slide receptacle 25 in the recess 19 causes the slides 29 with their inner faces 33 to be radially pressed against each of the associated commutator segments 7. Commutator segments 7 are thus pressed between the teeth 23 of the lower die 22, while the cross pieces 8 connecting the commutator segments 7 and are bowed outwardly.

Similarly, the recess 35 of the slide 29 presses against the rim of the flange 4, so that the cross pieces 11 connecting the lugs 10 are bowed outwardly. In this first reduction stage of the power stroke, the outer diameter of the blank 1 in the area of the commutator segments 7 and the connection lugs 4 is made smaller by the slide receptacle 25 with the slides 29. The segmental grooves 6 and the slits 9 in the flange 4 are correspondingly pressed together, i.e. adjacent elements pressed toward each other.

Figure 8:
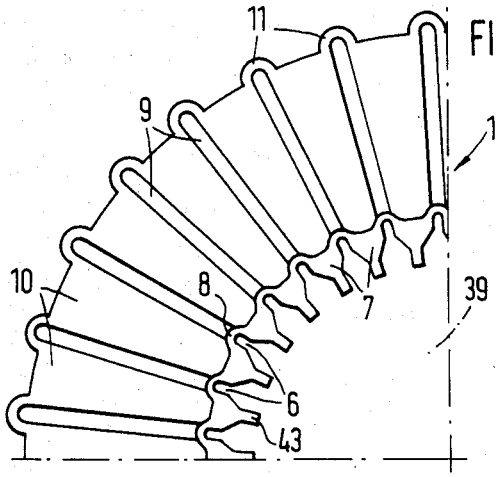
FIG. 8 is a partial and enlarged cross section of the blank along arrow VIII in FIG. 4.
Figure 4:
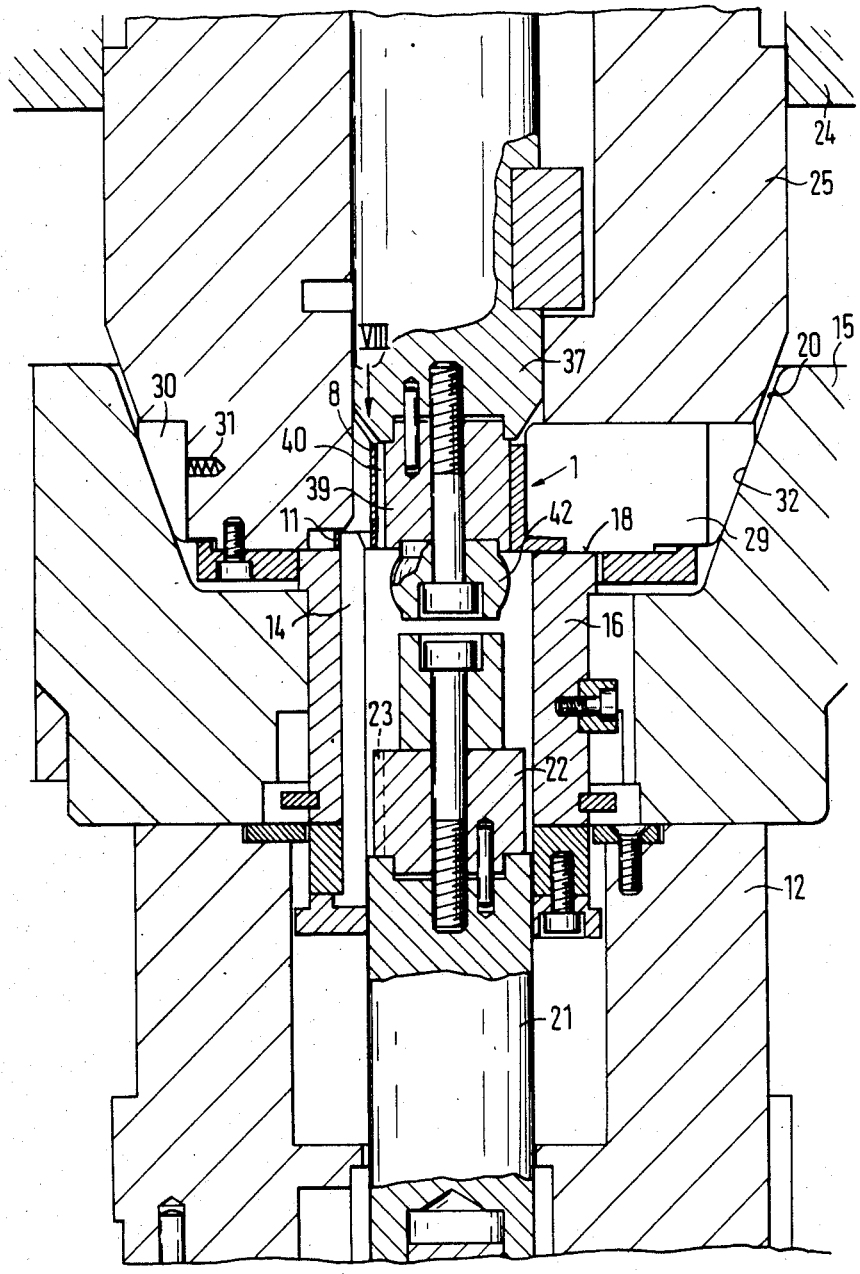
FIG. 4 shows the apparatus at the end of the second stage of the power stroke.
Figure 5:
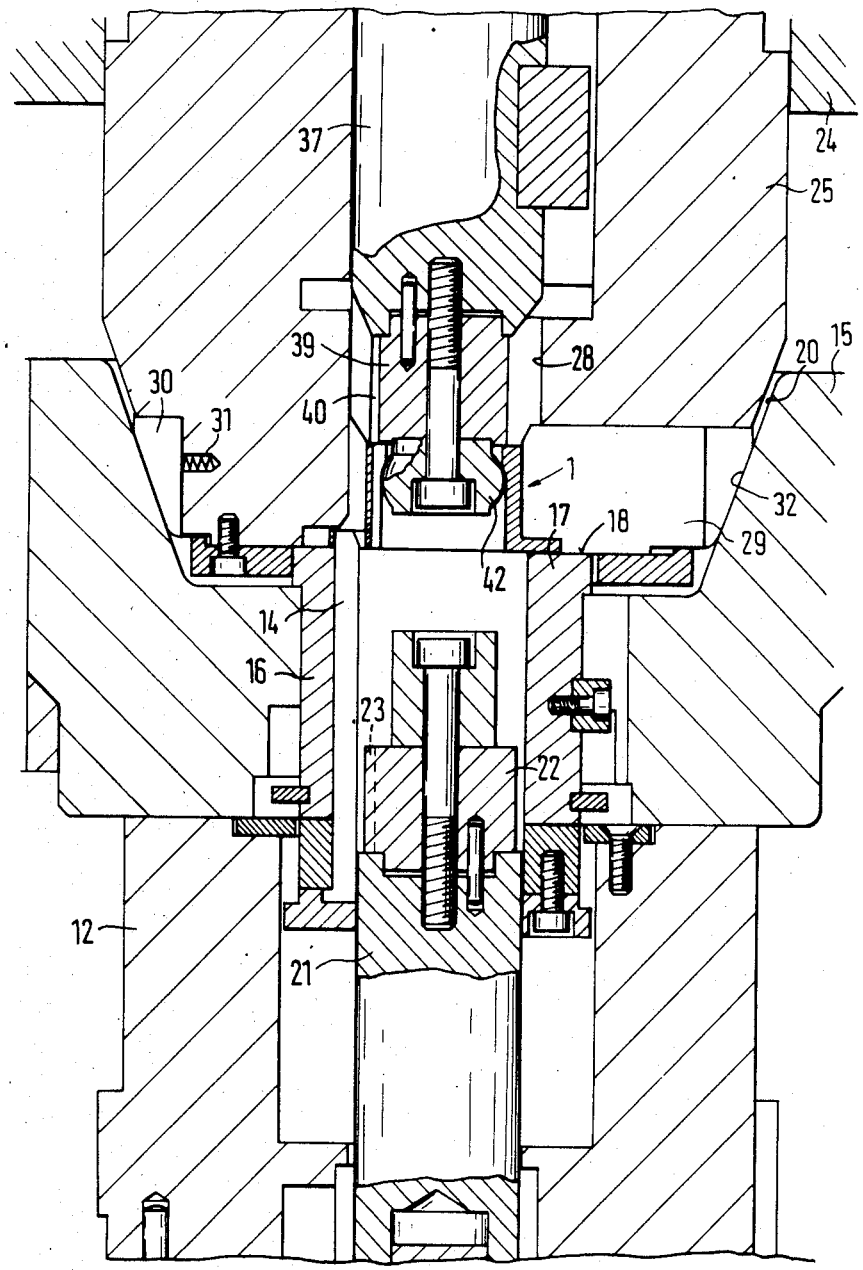
FIG. 5 shows the apparatus during the return stroke.

At the end of the first reduction stage of the power stroke, the lower punch 21 with the lower die 22 are moved back out of the blank 1 into the die 16, while the upper punch 37, the upper die 39 and gauging ring 42 are moved with respect to the stationary slide receptacle 25 toward the die 16, until the gauging ring 42 is pushed through the blank 1 and the upper die 39 lifts the blank 1, so that the teeth 40 grip along their entire length in the associated segmental grooves 6 of the blank 1 (FIG. 4). Then the slide receptacle 25 is moved somewhat further toward the punch plate 15, so that the slides 29 press the commutator segments 7 further between the teeth 40 of the upper die 39. In this second reduction stage of the power stroke the segmental grooves 6 and the slits 9 are further narrowed. In a single two-stage reduction process—such as the example just described—the diameter of the blank 1 is reduced at the end of the second reduction stage to the size of the commutator ring 2, and the segmental grooves 6 and slits 9 have been pressed together to their breadth in the commutator ring 2 (FIG. 8).

Figure 9:
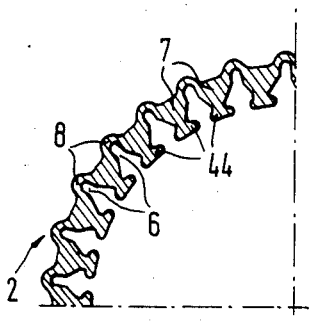
FIG. 9 is a partial and enlarged cross section along line IX—IX in FIG. 6.
Figure 6:
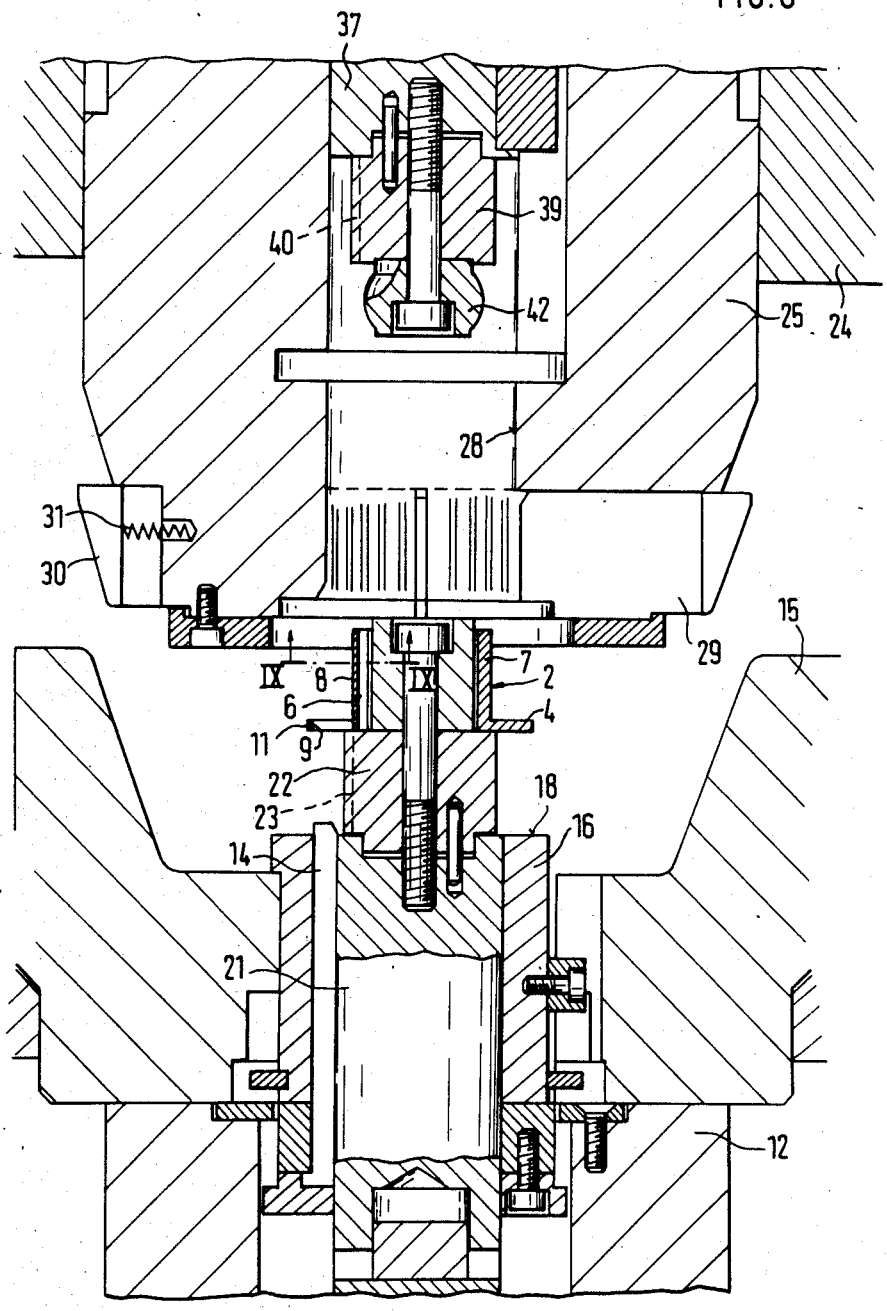
FIG. 6 shows the apparatus after the end of the return stroke, during ejection of the commutator ring formed from the blank.

At the end of the reduction process, the power stroke of the forming apparatus is also ended. The forming apparatus still remains closed (FIG. 5), while the upper punch 37 is moved back to its initial position. It pulls the upper die 39 out of the blank 1 and, finally, pulls the gauging ring 42 through the blank 1. The gauging ring 42 compresses the inner ends 43 of the commutator segments 7 in radial direction, so that the end is cold-formed into a dovetail-shaped anchor 44 (FIG. 9). Once the upper punch 37, together with the upper die 39, 40 and gauging ring 42, are pulled out of the finished commutator ring 2 and moved back into their initial position, the slide receptacle 25 is moved back into its initial position (FIG. 6). The spring arrangement 31 presses the slides 29 outwardly into their initial position. The lower punch 21 is pushed into its initial position in die 16. The lower punch 21 with the lower die 22 acts as an ejector for the commutator ring 2, in that the lower die 22 presses against the face of the flange 4 and the commutator ring 2 lifts off the face 18, which serves as a workpiece support, of the die 16. Commutator ring 2 can, in a known manner, not further described here, be removed and provided with an insulating hub, in which the commutator segments 7 with their dovetail-shaped ends 44 are anchored. In a known manner not described here, the commutator segments 7 are then separated from each other by removal of the cross pieces 8 and 11, the connection lugs 10 are provided with slits 7, and the commutator is completed.

Figure 10:
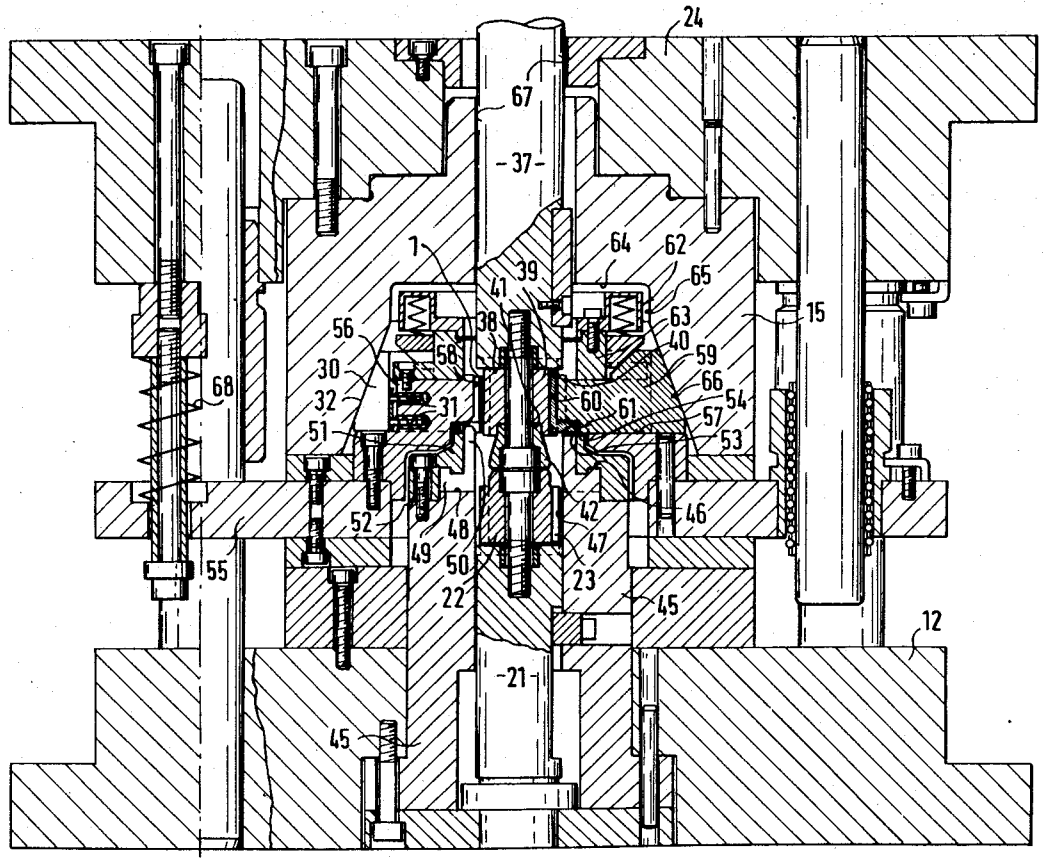
FIG. 10 shows a second embodiment of the forming apparatus with multi-part dies at the end of the second stage of the power stroke, partially in longitudinal cross section.

A second embodiment of the forming device is illustrated in FIG. 10. Insofar as the parts correspond to those of the first embodiment, they have been given the same reference numbers. The forming apparatus has again a multi-part two-stage reducing die. The slides are disposed in the lower part of the apparatus on a portion which is stationary during the forming process. The punch plate, on the other hand, is fastened on an upper part which is movable during the forming process.

the hollow guide element 45 for the lower punch 21 is located in the lower support plate 12. The lower die 22 is screwed on the face of the lower punch 21, and is provided with teeth 23. On the face 46 of the guide element 45, radial slit-shaped recesses 48 are formed extending from the central bore 47, in which punch 21 rides. The recesses 48 are formed with the same angular intervals as the slits 9 in the flange 4 of the blank 1. In each recess 48, a hook-shaped safety member 49 is placed which has a section 50 corresponding to that of the locking pins 14 of FIGS. 2 through 6. The safety parts 49 are screwed onto recess 52 of the face 46 with a forming ring 51 which grips into the hook-shaped safety parts 49 and the correspondingly formed face 46 of the guide element 45. The sections 53 of the faces 46 between the sections 50 of the safety parts 49 form together with the face 54 of an end section of the form ring 51 the workpiece support for the blank 1. Sections 50 of the safety parts 49 project over the faces 53 and 54 and over the workpiece support and project into the intake area for the blank 1.

A middle support plate 55 is movably disposed with relation to the lower support plate 12. On the middle support plate 55, a slide receptacle 56 is fastened, which is shaped as a forming ring. The slide receptacle 56 has radial slits 57 in the same angular intervals as the sections 50 of the safety parts 49. The slits 57 open into a section 58 of the central bore of the slide receptacle 56. The base of the slits 57 lies on the level of the workpiece support formed by the face sections 53 and 54. The slits 57 align with the sections 53 of the face 46 of the guide element 45. In each slit 57, a radially movable slide 59 is placed. The inner surface 60 of the slide 59 which projects into the bore section 58 has the form and size of the outer surface of the commutator segment 7 of the blank 1 including the flange 4 which later forms the connection lugs 10. The slide 59 is provided with a recess 61 corresponding to the flange 4. The outer end of the slide 59 is, like that of the slides 29 of FIGS. 2 through 6, formed as a bearing surface 30, adjacent to which is the spring arrangement 31, which supports itself against the slide receptacle 56. The outer face 32 of the slide 59 is again sloped. A spring powered guiding arrangement 62 holds the slides 59 pressed to the base of the slits 57. It is provided with a bearing ring 63 which limits the radial movement of the slides 59, which are pressed outwardly by the force of the spring arrangement 31.

On the upper support plate 22 is fastened the bell-shaped punch plate 15, on whose underside a coaxial recess 64 with a cylindrical section 65 is formed. Connected to the cylindrical section 65 is a conically widening end section 66. In a central bore 67 of the punch plate 15 and the upper support plate 22, the upper punch 37 is introduced in a longitudinally movable manner. On its face 38 is again disposed the upper die 39 with teeth 40. On the face 41 of the die 39 rests the gauging ring 42. The upper die 39 and the gauging ring 42 are screwed onto the upper punch 37. The upper support plate 24 is supported on the middle support plate 55 by a spring arrangement 68. These two support plates 24 and 55 are movable together relative to each other, as are the parts fastened to them, namely, the punch plate 15, the slide receptacle 56 with slides 59, the spring arrangement 31 and the guide arrangement 62.

The forming apparatus is illustrated in FIG. 10 in its position at the end of the power stroke. In its initial position upon insertion of the blank 1, the middle and upper support plates 55 and 24, with the slide receptacle 56 and slide 59, punch plate 15 and upper punch 37 are raised from the lower support plate 12 and from the workpiece support 53, 54, against the guide element 45 and forming ring 51, in their highest position. The upper punch 37 is therefore drawn so far back into the central bore 67 that the upper die 37 and its gauging ring 42 are pulled out of the bore 58 in the region of the slides 59. The lower punch 21 is pushed so far into the guide element 45 that the adjacent face of the lower die 22, together with the face sections 53, 54 and the workpiece support, all lie at one level.

OPERATION

The blank 1 is placed on the lower die 22, so that its flange 4 rests on the face sections 53, 54 of the workpiece support. The ends 50 of the safety parts 49, which project on the sections 53, 54, lock into the slits 9 in the flange 4 of the blank 1. The blank 1 is thereby fixed in its position in the forming apparatus. The ends 50 of the safety parts 49 also prevent the slits 9 from being changed to an undesired form during the translation of the blank 1 into the commutator ring 2.

In the first stage of the power stroke for reduction of the blank 1, the middle and upper support plates 55 and 24 are moved axially onto the blank 1, until the middle support plate 55 rests on the lower support plate 12. The slide receptacle 56 then surrounds the blank 1 at a distance with its bore section 58, while the base of the slits 57 and the lower surface of the slides 59 rests at the level of the face sections 53, 54 and the face of the flange 4 of the blank 1. Against the force of the spring arrangement 68, the upper support plate 24 with the bell-shaped punch plate 15 is moved axially onto the middle support plate 55.

The conical section 66 of the punch plate 15 presses against the sloped outer face 32 of the slides 59 and simultaneously pushes the slides 59 radially against the commutator segments 7 of the blank 1, while the crosspieces 8 connecting the segments 7 are bowed outward, and the segmental grooves 6 are narrowed, corresponding to the form of the teeth 23. Simultaneously, the recess 61 of the slide 59 presses on the rim of the flange 4 and thus on the later connection lugs 10. The cross pieces 11 between the slits 9 are thus bowed outward and the slits 9 are narrowed.

Once the commutator segments 7 rest on the flanks of the teeth 23 of the lower die 22, the movement of the upper support plte 24, with the punch plate 15, is stopped. The upper punch 21, along with the lower die 22, is withdrawn into the guide element 45, while the upper punch 23 is moved onto the blank 1 until the upper die portion 39 rests in the blank 1. Then the punch plate 15 is moved by the upper support plate 24 axially further onto the middle support plate 55. The conical section 66 of the punch plate 15 presses again on the sloped faces 32 of the slides 59. The slides 59, together with the recess 61, press on the commutator segments 7 and on the flange 4, so that the segments 7 are pressed between the teeth 40 of the upper die 39, and the crosspieces 8 and 11 are bowed outward. Once the punch plate 15 rests with its face on the middle support plate 55 (FIG. 10), the power stroke is ended, and the blank 1 has been reduced to the desired dimensions of shaft diameter, segmental grooves 6 and slits 9 (FIG. 8).

While the forming apparatus is kept closed, the upper punch 37 is pulled back. The upper die 39 is moved out of the blank 1, and, finally, the gauging ring 42 is drawn through the blank 1. The gauging ring 42 again transforms the inner ends 43 of the commutator segments 7 into anchoring means 44, which extend in a dovetail configuration into the segmental grooves 7. The blank has now been cold-formed into a commutator ring 2.

Once the upper punch 37 has been moved back into its initial position, the forming apparatus is opened. The upper support plate 24 is pushed by the force of the spring arrangement 68 away from the middle support plate 55, while the spring arrangement 31 presses the slides 59 outward. The two support plates 24 and 55, along with the punch plate 15 and the slide receptacle 56, slides 59, and spring arrangement 31, are commonly moved away from the lower support plate 12 into their initial position. At the same time, the upper punch 21, along with the lower die 22 in the guide cylinder 45, is pushed back into its initial position.

Thus, the lower die 22, 23 presses against the face of the connection lugs 10 of the commutator ring 2 and raises it off the ends 50 of the safety parts 49, so that the commutator ring 2 can be removed from the forming apparatus.

In accordance with the method of the invention, with the second embodiment of the forming apparatus according to FIG. 10, the anchoring means 44 are again formed during the return stroke of the upper punches 37, 42 and the lower punch 21, 22 acts during its return to its initial position after the ending of the former process as an ejector for the commutator ring 2.

Figure 11:
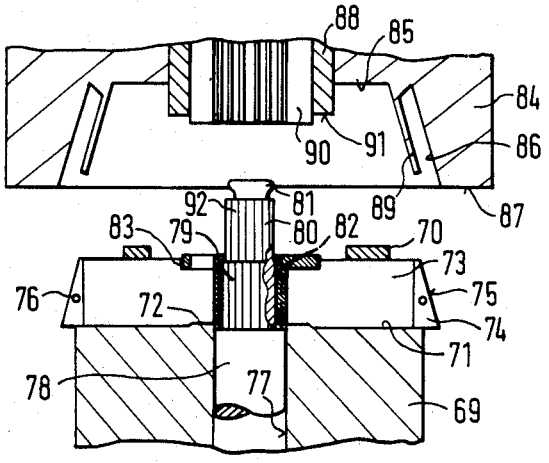
FIG. 11 shows a third embodiment of the forming apparatus with multi-part dies, in the initial position with an inserted blank.

FIG. 11 shows a third embodiment of the forming apparatus with a unitary two-stage die for the cold formation of the blank 1 into the commutator ring 2 through a two-stage reduction, and formation of anchoring means 44, in simplified form.

The forming apparatus is shown in its initial position. It has a guide element 69 with a slide receptacle 70 with slits 71 in the lower part of the apparatus. The base of the guide element 69 is somewhat beneath the level of the surface 72 thereof. This surface 72 serves as the workpiece support. Slits 71 are formed in equal angular intervals to each other. The slider 73 which ride in the slits 71 have an inner face in the form and size of the outer face of the commutator segment 7 of blank 1. On their outer ends, the slides 73 are provided with a bearing surface 74. The outer face 75 of the slides 73 is again sloped. On the bearing surface 74 of the slides 73 is formed a cam 76, on which the slides 73 are moved back into their outer, initial position.

A punch 78 is movably received in a central bore 77 of the guide element 69. At the upper end of the punch 78, a die is fastened with a first die section 79, a second and final die section 80 and an end formed as a gauging ring 81. The first die section 79 is provided with longitudinally running teeth 82 which are regularly spaced around the entire circumference. The teeth 82 correspond to the segmental grooves 6 of the blank 1. The cross section of the teeth 82 of the first die section corresponds to the cross section of the segmental groove 6 of the blank 1 at the end of the first reduction step. The slides 73 are provided with a recess 83, which is recessed from the inner face of the slides 73 by the breadth of the flanges 4 of the blank 1. In the initial position of the punch 78, the end of the first die section, which adjoins the punch 78, is on the level of the slits 71 and of the underside of the slides 73 which ride in the slits 71.

A bell-shaped punch plate 84 which is longitudinally movable with respect to the guide element 69 is provided with a recess 85 whose wall 86 slopes to the face 87 of the punch plate 84. The punch plate 84 rides on a hollow cylindrical spacer 88 of the upper portion of the apparatus. From the recess 85, return rails 89 run parallel to the wall 86. In the hollow cylindrical spacer 88 ride locking pins 90 whose ends project at the face 91 of the spacer 88 and are radially disposed, corresponding to the slits 9 in the flange 4 of the blank 1.

OPERATION

In the open forming apparatus, the blank a is inserted, so that the face of its shaft 3 rests on the surface 72 of the guide element 69, and its flange 4 rests on the recess 83, while the first die section 79 rests in the blank 1.

In the first reduction stage, the spacer 88 with the locking pins 90 is moved onto the blank 1, until the locking pins 90 project into the slits 9 in the flange 4 of the blank 1, and the surface 91 of the spacer 88 rests on the surface of the flange 4. The punch plate 84 is meanwhile moved onto the guide element 69, so that the sloped wall 86 of the recess 85 presses on the sloped face 75 of the slides 73, while the return rails 89 slip along the inner side of the cams 76 of the slides 73. During the axial movement of the punch plate 84, the slides 73, 83 are radially pressed onto the commutator segments 7 and the flange 4 of the blank 1. Segments 7 are thus pressed between the teeth 82 of the first die section 79, until they rest on their flanks. The segmental grooves 6 and the slits 9 are thus narrowed and the cross pieces 11 which connect the segments 7 and the connection lugs 10 are bowed outwardly. When the segments 7 are adjacent the flanks of the teeth 82, the axial movement of the punch plate 84 is stopped. The punch 78 is moved in the guide element 69 until the second die section 82 is in the blank 1. Then the axial movement of the punch plate 84 is continued, so that the slides 73 press the commutator segments 73 between the teeth 92 of the second die section 80. The segmental grooves 6 and the slits 9 are thus reduced to the desired final size, as are the diameter of the shaft 3 and of the flange 4 between the cross pieces 8 and 11 (FIG. 8).

When the apparatus is closed at the end of the power stroke, the punch 78 is drawn further into the guide element 69 and the gauging ring 81 is drawn through the blank 1. The inner ends 43 of the commutator segments 7 are formed into dovetail-shaped anchors 44, which extend in the circumferential direction into the adjacent segmental grooves 6 (FIG. 9), so that the blank 1 is completely formed into the commutator ring.

Upon opening of the forming apparatus, the punch plate 84 and the spacer 88 with the locking pins 90 are moved away from the formed commutator ring 2. The return rails 89 press against the cams 76 of the slides 73 and move the slides 73 outwardly into their initial position. The punch 78 is pushed into its initial position on the punch plate 84, until the first die section 89 reaches the level of the slides 73. The teeth 92 of the second die section 80 push the commutator ring 2 out of the region of the slide 73, so that it can be removed from the forming apparatus.

The method of the present invention can be very advantageously so performed, in the third embodiment of the forming apparatus; the anchoring means 44 are formed on the commutator segments 7 during withdrawal punch movement for pulling the second die section 80 out after the exemplary two-stage reducing process; and the punch 78, with the second die section 80, 92 fastened to it, serves as an ejector for the commutator ring 2 during the punch's return movement to its initial position after the reopening of the forming apparatus.

If the slits 9 and the segmental grooves 6 are to undergo only a slight size reduction, it suffices to make the die in one piece and operate in one stage. In case relatively large forming forces are required, for example in the case of blanks for large commutator rings, the reduction can involve more than two stages. The lower die 22 (FIGS. 2 through 6 and 10) can be formed advantageously in two or more stages, while the upper die 39 is used for the last reduction stage and is connected to the gauging ring 42. The gauging ring 42 (FIGS. 2–6), 8 (FIG. 10) functions simultaneously as a deforming die and gauging element, by mushrooming out the teeth of the segments 7 into the dovetail shape shown at 44, FIG. 9.

Various changes and modifications may be made, and any features described may be used with any of the others of the respective embodiments, within the scope of the inventive concept.

We claim:

1. A method of making a commutator ring having a tubular portion defining an outer tubular diameter, a flange defining an outer flange diameter, and a plurality of segments having connection lugs and anchoring means, said method comprising the steps of:

providing a tube-shaped blank having a tube portion with an inner wall and defining an outer tube diameter, a radially outwardly projecting flange portion located at one end of said tube portion, having lug sections and defining an outer initial lug diameter, segmental grooves in said inner wall, and radially inwardly projecting segments defined by said grooves, located between said grooves and having end portions;

providing the tube-shaped blank with radially extending separating slits in the flange portion thereby partially separating said flange portion into radially extending connection lugs, while maintaining said flange portion as a connected, slitted structure;

placing said tube-shaped blank in a first die of a forming apparatus;

penetrating the separating slits with locking pins thereby retaining said tube-shaped blank in position in the forming apparatus;

in a single working step, reducing the outer diameter of said tube portion to the outer diameter of the tublar portion and reducing the outer diameter of said flange portion to the outer diameter of the flange by engaging reduction elements with said tube-shaped blank and causing the reduction elements to press radially inwardly against said tube-shaped blank while retaining said tube portion throughout its length as a continuous tubular element and while maintaining said flange as the slitted structure, and forming the anchoring means by deforming the end portions of the radially inwardly projecting segments by axially moving a deforming die element from an initial position through said tube-shaped blank while continuously pressing the reduction elements against said tube-shaped blank;

withdrawing the deforming die element to the initial position; and then ejecting said tube-shaped blank, upon opening of the forming apparatus, by moving the first die to an open position.

2. The method of claim 1, wherein the step of reducing the outer diameter of the flange portion and the tube portion comprises moving elements of the apparatus axially and transforming this axially directed movement to a radially directed movement, applying the radially directed movement to the reduction elements, and moving the reduction elements radially inwardly simultaneously against individual segments and to the connection lugs.

3. The method of claim 1, wherein said reduction elements are radially movable slides and the segmental grooves define a depth, said method further including the steps of providing an axially movable punch plate, and reducing the depth of the segmental grooves (6) by radially pressing on the segments and lugs, while pressing inner sides of the segments between teeth of the die by radial movement of the slides during axial movement of the punch plate, thereby forming said anchoring means by deforming the segments.

4. The method of claim1, wherein the step of reducing the outer diameter of the tube portion is carried out in more than one stage, the method further including the steps of providing the deforming die with first, second and third sections of different diameters, said first, second and third sections having tooth sections having a profile corresponding to that of the segmental grooves (6), pressing the blank (1) onto a section of the first die having a large diameter in a first stage by the slides (73) when the slides act radially as reduction means, and subsequently moving the first die in a forming apparatus axially with respect to the blank and a support plate;

deforming the blank to a next smaller diameter in a second stage, including pressing the slides further radially on the segments (7) and lugs (10) by means of a punch plate, while further pressing the segments (7) between the teeth of the deforming die element.

5. The method of claim 4, further including the steps of opening the forming apparatus, and ejecting the commutator ring (2) by movement of the deforming die element to its initial position.

6. The method of claim 1, wherein the deforming die element includes a gauging apparatus comprising at least one gauging ring fastened on the die having teeth corresponding to the segmental grooves (6) of the commutator ring (6), and further including the steps of pulling the gauging apparatus through the blank (1) during movement of the deforming die to its initial position, and holding said blank by the slides in a support plate while forming the segments (7) formed into dovetails (44).

7. The method of claim 1, further including the steps of opening the forming apparatus, and ejecting said tube-shaped blank during movement of the deforming die element to its intial position.

8. The method of claim 1, further including the steps of supporting the blank on a lower support plate, which receives the slides (59), processing said blank by a one-part, two-stage die with gauging apparatus, while moving a punch plate, fastened to an upper support plate, axially onto the slides, and pressing radially on the segments.

9. Method according to claim 1, wherein the slitted structure defines connecting cross pieces located, respectively, at radially outward ends of the separating slits in the flange portion;

and further including the step of bowing the connecting cross pieces and narrowing the slits.

10. The method of claim 1, wherein said reduction elements comprise slides which are movable radially inwardly with respect to the tube-shaped blank;

and wherein the method step of engaging the reduction elements comprises applying said radially movable slides inwardly against said tube portion and against the flange portion, while maintaining continuous connecting material of the blank between said tube portion and the flange portion over the entire length of said blank.

11. Method according to claim 10, wherein said step of applying said movable slides against said segments further comprises pressing said segments against corresponding, longitudinally running teeth on the outer, cylindrical surface of said die to form the anchoring means.

12. Method according to claim 9, wherein said step of applying said movable slides against said segments further comprises pressing said segments against corresponding, longitudinally running teeth on the outer, cylindrical surface of said die to form the anchoring means.

13. The method of claim 10, wherein the forming apparatus includes a holding element retaining said slides, said slides and said holding element being formed with matching inclined surfaces;

said forming apparatus further includes a pressure plate;

and wherein the step of applying said radially movable slides inwardly against said tube portion and against the flange portion comprises axially moving the pressure plate with respect to said holding element to cause radial movement of said slides by axial movement of the pressure plate.

14. Method according to claim 10, wherein the slitted structure defines connecting cross pieces located, respectively, at radially outward ends of the separating slits in the flange portion;

and further including the step of bowing the connecting cross pieces and narrowing the slits.

* * * * *